US008544915B1

(12) United States Patent
Winkler

(10) Patent No.: US 8,544,915 B1
(45) Date of Patent: Oct. 1, 2013

(54) MODULAR BEVERAGE TRANSPORT SYSTEM

(76) Inventor: Richard G. Winkler, East Greenwich, RI (US)

( * ) Notice: Subject to any disclaimer, the term of this patent is extended or adjusted under 35 U.S.C. 154(b) by 0 days.

(21) Appl. No.: 13/290,228

(22) Filed: Nov. 7, 2011

(51) Int. Cl.
*A45F 5/00* (2006.01)

(52) U.S. Cl.
USPC ..... 294/160

(58) Field of Classification Search
USPC ..... 294/27.1, 137, 160, 87.2, 144; 206/428, 206/162, 200; 220/754, 755, 756, 759; 229/117.26, 120.07, 120.38
See application file for complete search history.

(56) References Cited

U.S. PATENT DOCUMENTS 3,097,740 A * 7/1963 Ougljesa ..... 206/143
D288,054 S 2/1987 Schulte et al.
5,188,413 A * 2/1993 Nathan ..... 294/87.2
5,356,107 A 10/1994 Sinohuiz
5,433,373 A * 7/1995 Zoeller ..... 229/117.26
5,487,465 A * 1/1996 Broskow ..... 206/150
D412,663 S * 8/1999 Erickson ..... D9/752
6,010,104 A 1/2000 Hanson et al.
6,095,584 A * 8/2000 Walsh et al. ..... 294/166
6,769,853 B2 * 8/2004 Perrot ..... 411/553
6,796,853 B1 * 9/2004 Tomasino ..... 439/784
7,360,666 B1 4/2008 Primel et al.
D570,162 S 6/2008 Blais
2002/0148868 A1 10/2002 Dion-Bildstein et al.
2007/0045496 A1 3/2007 Kane
2009/0120948 A1 5/2009 Ezzy et al.

* cited by examiner

*Primary Examiner* — Stephen Vu
(74) *Attorney, Agent, or Firm* — Montgomery Patent & Design; Robert C. Montgomery

(57) ABSTRACT

A beverage transport system used for the transportation of beverages includes a plurality of ring-shaped cup holders that engage tapered sides of a beverage cup. "T"-shaped fasteners and slots enable attachment of appropriately sized carrying handles to enable one-hand transportation of both hot and cold beverages. In addition to cup holders the system can incorporate a box-like tray to carry food stuffs, condiments, and other related items.

4 Claims, 6 Drawing Sheets

MODULAR BEVERAGE TRANSPORT SYSTEM

RELATED APPLICATIONS

There are currently no applications co-pending with the present application.

FIELD OF THE INVENTION

The presently disclosed subject matter is directed towards beverage transport systems. More particularly, the present invention relates to beverage transport systems having at least one ring-shaped cup holder that engages with tapered sides of a beverage cup, removable fasteners, and appropriately sized carrying handles.

BACKGROUND OF THE INVENTION

Fast-food restaurants and take out food stores make food and beverages available quickly and at low cost. Often, purchased food and beverages are carried away from the purchase service area for later consumption. For example, fast food restaurants often sell food and beverages from drive-through windows, while stadiums sell food and beverages to customers who take their purchases to their seats or to other eating locations.

Often, purchased food and drink are packaged by placing them in a box or other carrier to make transportation easier. Sometimes, as in the case of hot tea or coffee, the packaging must not only enable carrying the items but also protection of the carrier from burns. As is well known it is not at all uncommon for beverages to spill. One (1) reason for this is that most beverage containers are top-heavy. Another problem with transporting beverages is that they are often purchased in multiple quantities. Handling two (2), three (3), or four (4) drinks at a time is rather difficult using prior art beverage transport systems. Yet another problem is that it is not at all uncommon for a purchaser to have to carry other items at the same time as beverages. In such cases it can be difficult to find and use things such as keys or pens since all of the items being carried have to be put down and then picked back up again. This can be difficult to do with prior art beverage transport systems.

One (1) approach to reducing the difficulty of transporting multiple beverage containers is to place individual drinks into a "box" shaped beverage container. Prior art "box" shaped beverage containers have a problem in that the individual drink cups still tend to tip over, a particular problem when the box beverage containers must handle different sized cups. The largest cups fill the cup holder while smaller cups tend to be under supported. Tipping is not at all uncommon with such systems.

Therefore an improved beverage transport system for transporting drinks would be beneficial. Even more beneficial would be an improved beverage transport system that makes handling beverage cups easier and with less chance of tipping. Particularly beneficial would be a one-size fits all beverage transport system that simplifies transporting drinks, setting them down, and then picking them back up. Preferably a beverage transport system would enable one-handed carrying, even of multiple beverage cups. A beverage transport system that enables multiple beverages to be easily transported would be particularly useful, especially if it was low cost, disposable and expandable to enable multiple beverages to be easily transported, set down, and picked back up.

SUMMARY OF THE INVENTION

The principles of the present invention provide for an improved beverage transport system for transporting drinks. Using those principles a beverage transport system could make handling beverage cups easier and with a reduced chance of tipping. Those principles further enable a simply beverage transport system that allows a user to easily set beverages down and then to pick them up again using only one (1) hand. Those principles further provide for a beverage transport system that is low cost, disposable, and expandable and that to enables multiple beverages to be easily transported, set down, and picked back up.

Those principles are incorporated in a modular beverage transport having a cylindrical container collar that is configured to receive and hold a beverage container. In one (1) embodiment the container collar includes two spaced apart fastener slots. A carrying handle has a pair of handle slots. The beverage transport also includes a pair of rigid quarter-turn fasteners, each having a disc and a "T"-shaped locking feature. The rigid quarter-turn fasteners pass through the fastener slots and the handle slots to connect the carrying handle to the container collar. An elastic band can be connected across the diameter of the container collar to assist retaining the beverage container in place. Preferably the container collar forms a downwardly tapering conic section that mates with the beverage container, the carrying handle includes a widened ovular-shaped gripping section, the fastener slots are spaced about one-hundred-eighty degrees (180°) apart, and the carrying handle is made from a flat piece that is formed into an inverted "U"-shape.

In another embodiment a modular beverage transport uses a container collar assembly having a pair of cylindrical container collars that are connected together by a pair of side reinforcing members. Each side reinforcing member has a fastener slot. A carrying handle having a pair of handle slots is then connected to the container collar assembly. That connection is made by a pair of rigid quarter-turn fasteners, each having a disc and a "T"-shaped locking feature that extends from its disc. The "T"-shaped locking feature is passed through the fastener slots and handle slots and turned a quarter turn. An elastic band can be connected across the diameters of the container collars to assist retaining the beverage containers in place. Preferably the container collars each form a downwardly tapering conic section that mates with a beverage container, the carrying handle includes a widened ovular-shaped gripping section, and the carrying handle is made from a flat piece that is formed into an inverted "U"-shape.

In yet another embodiment a modular beverage transport includes a first container collar assembly having a first pair of cylindrical container collars that are connected together by a first pair of side reinforcing members, at least one having a fastener slot, and a second container collar assembly having a second pair of cylindrical container collars that are connected together by a second pair of side reinforcing members, at least one having a fastener slot. That embodiment further includes a carrying handle having a pair of handle slots and a pair of rigid quarter-turn fasteners, each having a disc and a "T"-shaped locking feature that extends from its disc. The "T"-shaped locking feature of each rigid quarter-turn fastener passes through a different fastener slot and a different handle slot. The "T"-shaped locking features are turned to connect the carrying handle to the first container collar assembly and to the second container collar assembly. In some versions the first container collar assembly is directly attached to the second container collar assembly. In other versions a box is disposed between the first container collar assembly and the second container collar assembly. In such cases, the box is beneficially attached to the first contain collar assembly using a third rigid quarter-turn fastener.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

| | |
|---|---|
| 10 | modular beverage transport system |
| 15 | single-container embodiment |
| 20 | first container collar |
| 22 | fastener slot |
| 24 | first elastic band |
| 30 | first carrying handle |
| 32 | gripping section |
| 34 | handle slot |
| 40 | quarter-turn fastener |
| 42 | disc |
| 44 | locking "T"-feature |
| 50 | two-container embodiment |
| 51 | two-container collar assembly |
| 52 | second container collar assembly |
| 54 | side reinforcing member |
| 56 | second elastic band |
| 58 | fastening area |
| 70 | four-container embodiment |
| 71 | four-container collar assembly |
| 72 | third container collar |
| 76 | center reinforcing member |
| 80 | second carrying handle |
| 90 | four-container with tray embodiment |
| 91 | tray assembly |
| 92 | tray side |
| 94 | tray floor |
| 110 | third carrying handle |
| 120 | beverage container |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
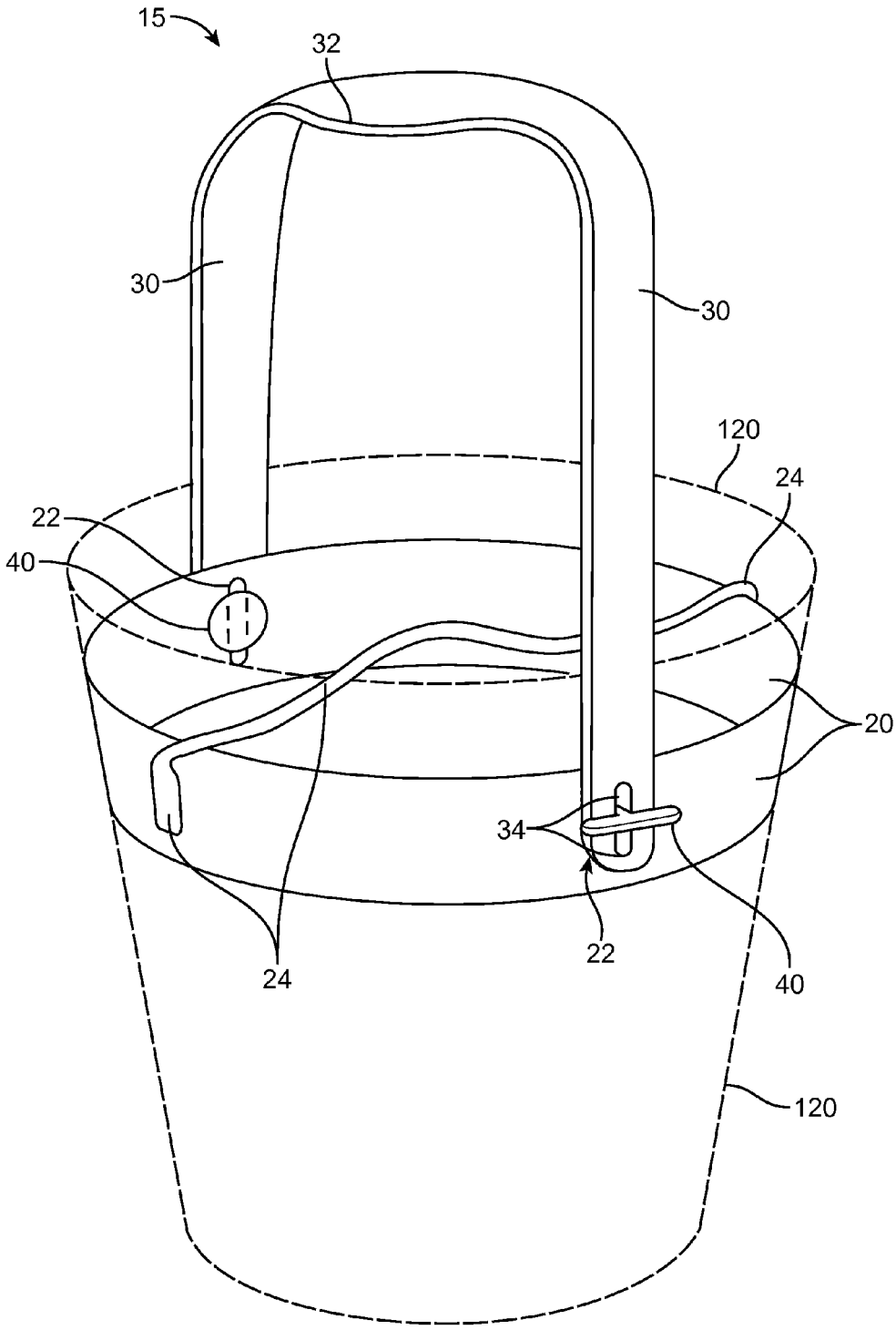
FIG. 1 is a perspective view of a single-container embodiment of a modular beverage transport system that is in accord with the principles of the present invention.

Referring now to FIG. 1, those principles provide for a modular beverage transport system 10 that aids a user in transporting one (1) or more beverage containers 120 containing a liquid such as coffee, soda, or another hot or cold beverage. The modular beverage transport system 10 comprises one (1), two (2), or four (4) ring collar structures 20, 52, 72 which are assembled along with corresponding carrying handles 30, 80, 110 to form single-handed yoke structures which provide a convenient one-handed beverage transport device. Such features allow for easy transportation of single or multiple containers of beverages 120 with reduced fear of spillage, burns, or other difficulty. The modular beverage transport system 10 is envisioned as being manufactured in a variety of attractive colors and patterns using materials such as extruded or stamped plastic strips, corrugated cardboard, rubber, or even metal.

FIG. 1 presents a perspective view of a single-container embodiment 15 of the modular beverage transport system 10. The single-container embodiment 15 comprises a first container collar 20 having a downwardly tapering conic section with a diameter and a taper which matches a profile of a common beverage container 120. The first container collar 20 is envisioned as being made using solid or corrugated paper, flexible or semi-rigid plastic or rubber strips, and the like. The single-container embodiment 15 uses a first carrying handle 30, envisioned to be made of paper or plastic, which is formed from a flat piece into an inverted "U"-shape.

Figure 6:
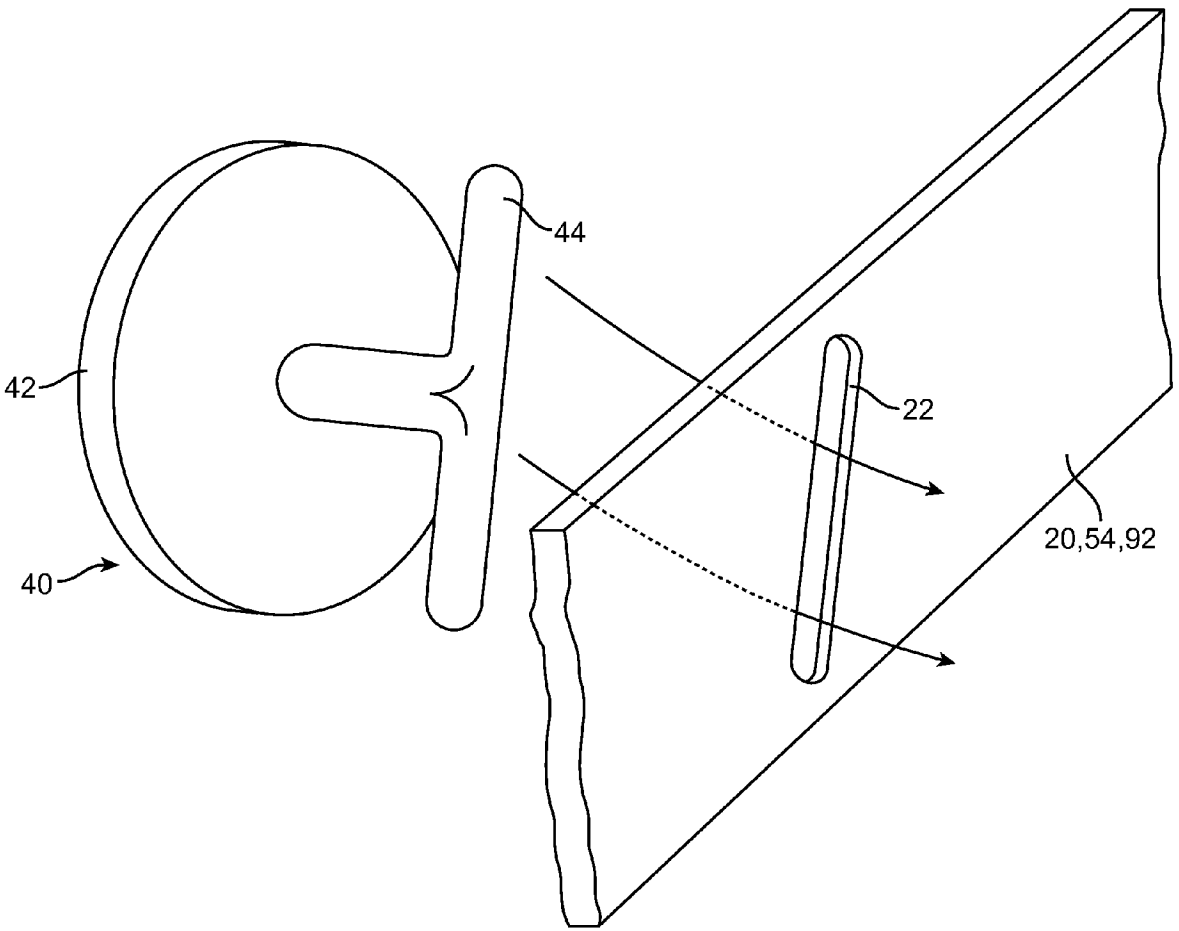

Still referring to FIG. 1, the first carrying handle 30 is affixed to the first container collar 20 along opposing surfaces via a pair of quarter-turn fasteners 40 (shown in more detail in FIG. 6). The first container collar 20 further comprises two (2) fastener slots 22 that are located approximately one-hundred-eighty degrees (180°) apart. In a similar manner, the ends of the first carrying handle 30 comprise corresponding handle slots 34. The fastener slots 22 and handle slots 34 have vertical openings that are approximately one-half (½) of an inch tall which when aligned, facilitate insertion and rotating of a locking "T"-feature 44 of the quarter-turn fastener 40 to secure the first container collar 20 and first carrying handle 30 together (also see FIG. 6). In practice the first carrying handle 30 will include a widened ovular-shaped gripping section 32 which provides additional stability during transportation.

The first container collar 20 is approximately one (1) inch high and slips from the bottom of a standard tapered beverage container 120 to support that container. Each first container collar 20 includes an affixed first elastic band 24 which extends diametrically across a top surface to secure loaded the beverage containers 120. This is especially useful when used in conjunction with containers 120 having lids. The elastic band 24 is envisioned as being made from an elastomeric rubber or plastic cord material that is affixed at its ends to the first container collar 20 using common attachment processes such as plastic welding, adhesive processing, or an equivalent method. The single-container embodiment 15 allows a user to easily carry a container of hot or cold beverage 120 while holding other objects, opening doors, and getting in and out of motor vehicles.

Figure 2:
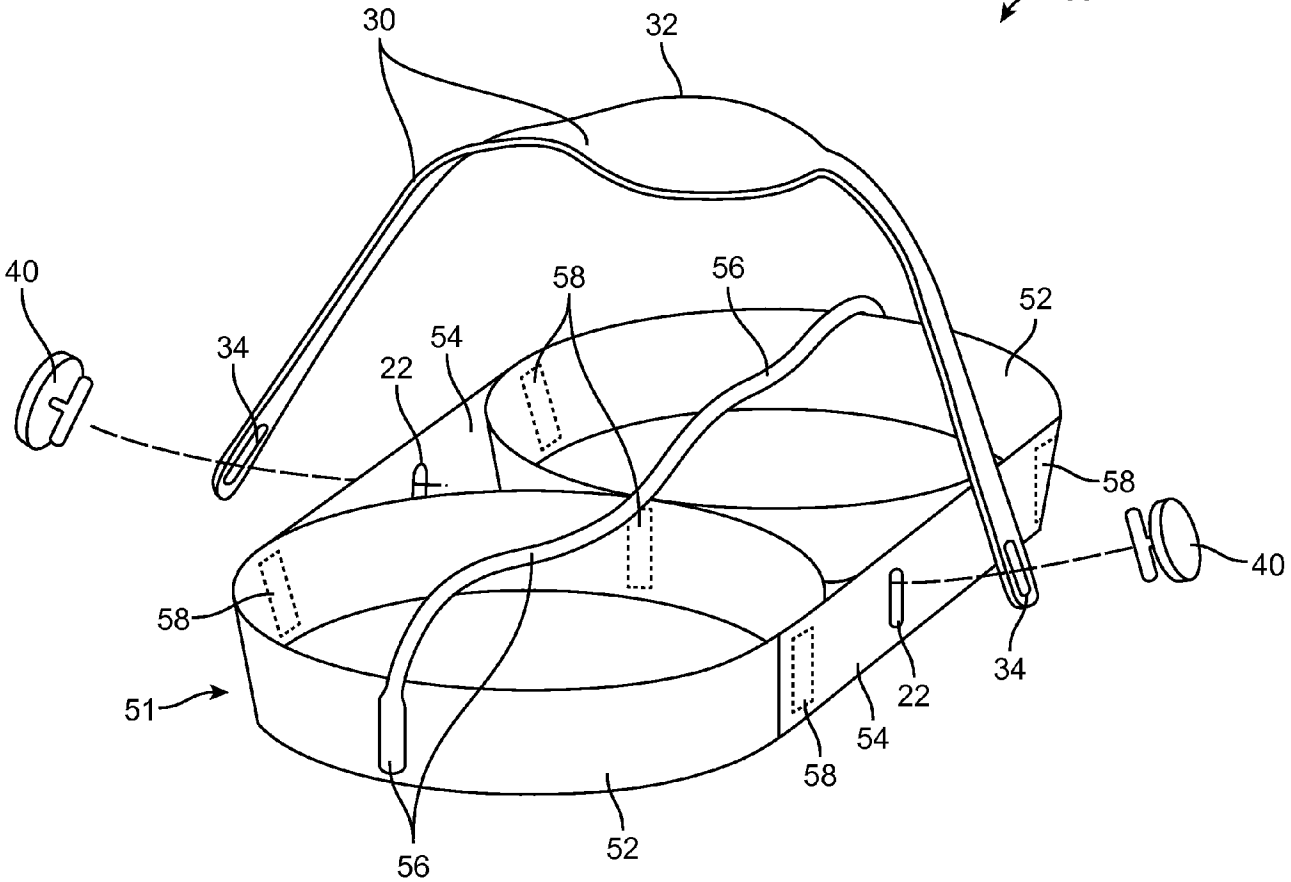
FIG. 2 is a partially exploded view of a two-container embodiment of the modular beverage transport system and which is in accord with the principles of the present invention.

FIG. 2 illustrates a partially exploded view of a two-container embodiment 50 of the modular beverage transport system 10. The two-container embodiment 50 provides balanced support for a pair of beverage containers 120 using an assembly comprising a second container collar assembly 52 having a pair of container collars that are connected together by a pair of side reinforcing members 54, and a second elastic band 56. The second container collars 52 are similar in shape, material, and function as the previously described first container collars 20. However, the second container collars 52 are affixed to each other and to the side reinforcing members 54 to form a unitary supporting structure that are permanently attached via a plurality of contacting fastening areas 58 using joining processes such as plastic welding, adhesive bonding, or equivalent method. The second elastic band 56 provides additional length to extend across the two (2) abutted second container collars 52.

Figure 3:
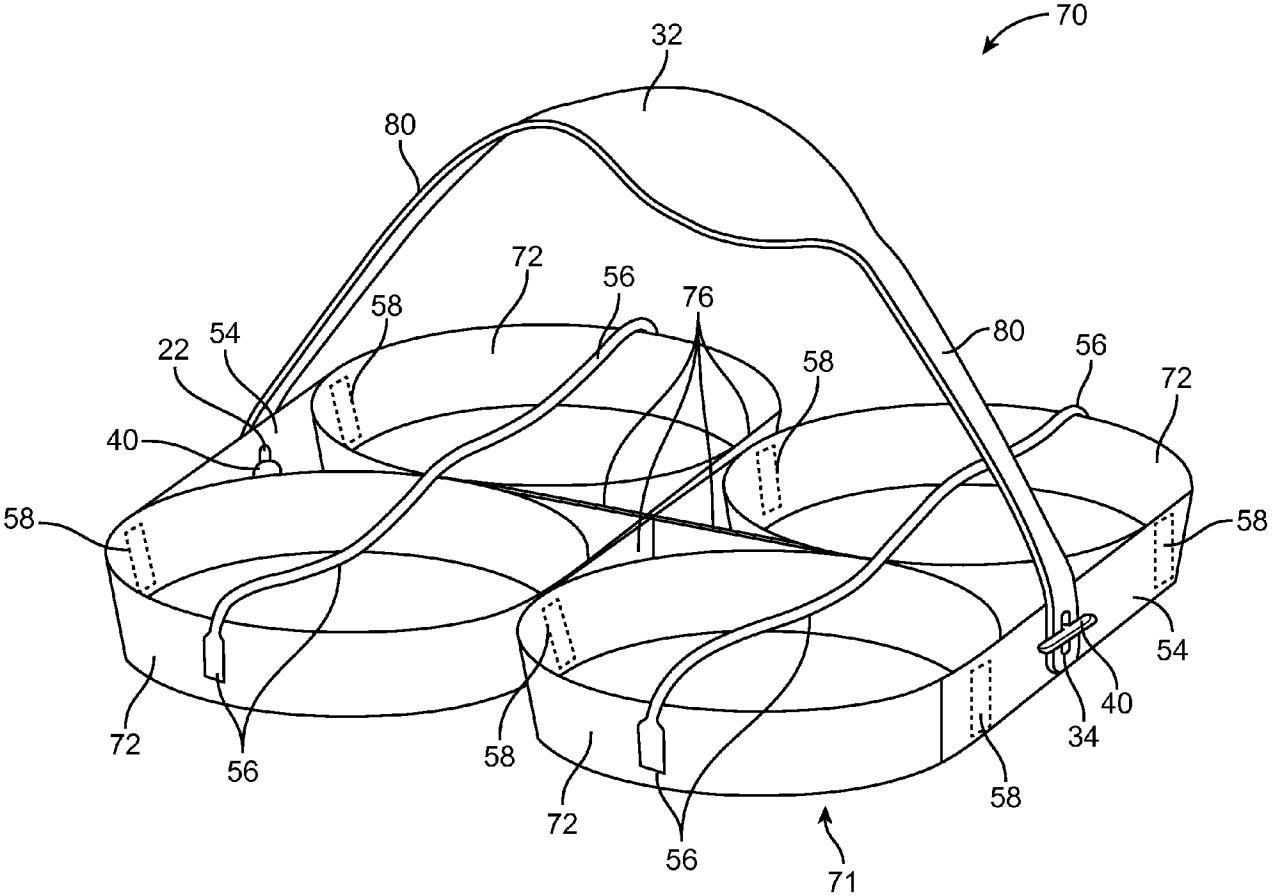
FIG. 3 is a perspective view of a four-container embodiment of the modular beverage transport system and which is in accord with the principles of the present invention.

FIG. 3 illustrates a perspective view of a four-container embodiment 70 of the modular beverage transport system 10. The four-container embodiment 70 uses a four-container collar assembly 71 which provides a unitary coplanar assembly of four (4) third container collars 72, a central "X-shaped center reinforcing member 76, and a pair of side reinforcing members 54. The four-container embodiment 70 is comprised of a similar construction and materials as the previously described two-container embodiment 50, being assembled using a plurality of fastening areas 58 which are envisioned to utilize plastic welding or adhesive bonding to form a unitary structure capable of supporting four (4) containers 120. The four-container embodiment 70 includes an elongated third carrying handle 80 and a pair of second elastic bands 56. The third carrying handle 80 is similar in construction and function as the previously described first 30 carrying handle, but comprises an increased length as needed to span the width of the four-container collar assembly 71. The second elastic bands 56 provide additional security across top surfaces of containers 120 having lids.

Figure 4:
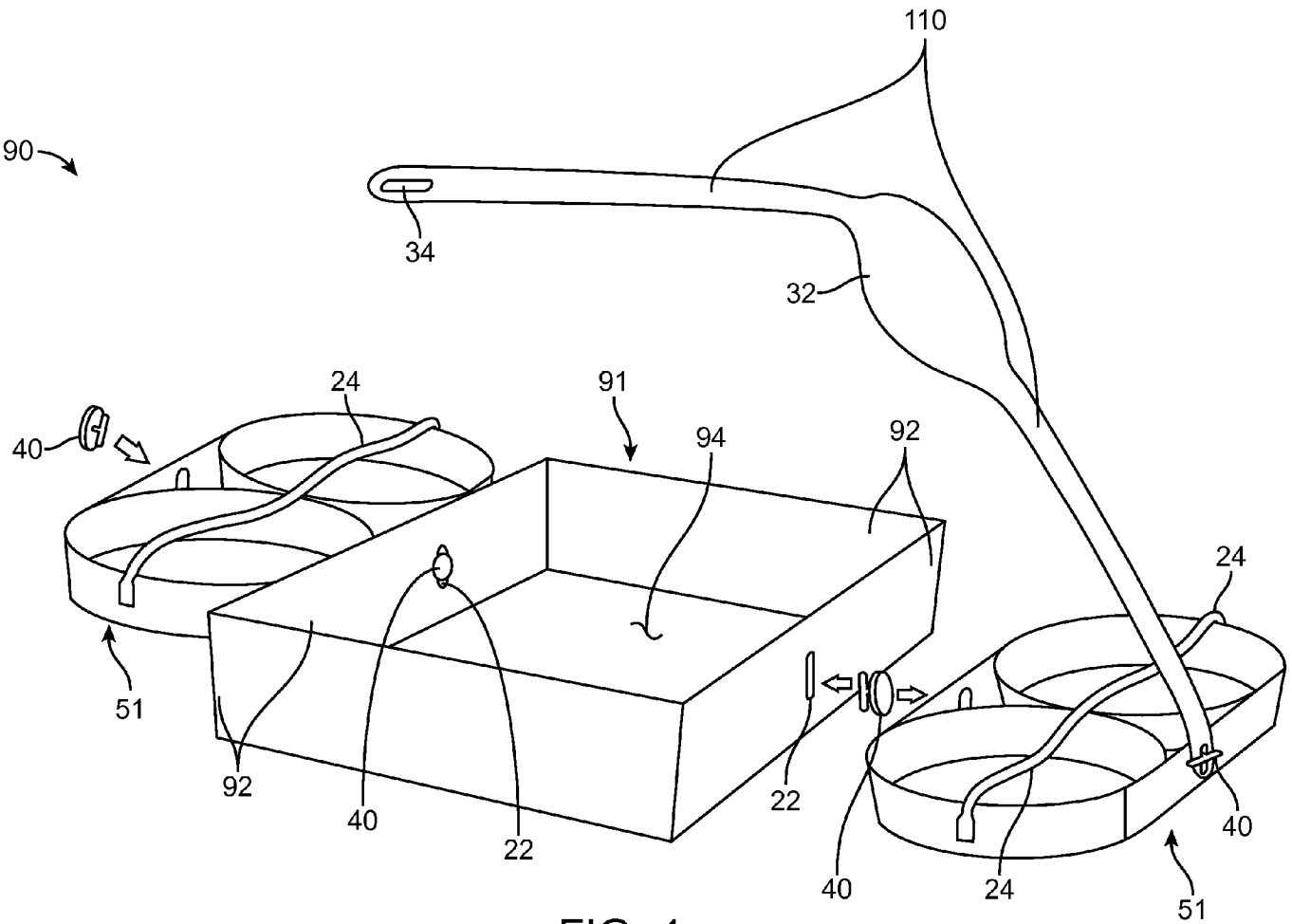
FIG. 4 is a partially exploded view of a four-container with box tray embodiment of the modular beverage transport system and which is in accord with the principles of the present invention.

Referring now to FIG. 4, a partially exploded view of a four-container with tray embodiment 90 of the modular beverage transport system 10, a four container carrier may be enhanced by adding a tray assembly 91. The tray assembly 91 enables a user to carry additional items such as food stuffs, condiments, and the like. The tray assembly 91 is envisioned to be made using similar materials and assembly methods as the aforementioned collar assemblies 20, 51, 71. The tray assembly 91 beneficially has a shallow open-top box structure having four (4) tray sides 92, a tray floor 94, and a pair of fastener slots 22 positioned along opposing tray sides 92. The four-container with tray embodiment 90 includes four (4) quarter-turn fasteners 40 to secure a pair of two-container collar assemblies 51 and a third carrying handle 110 to the centrally positioned tray assembly 91.

Figure 5A:
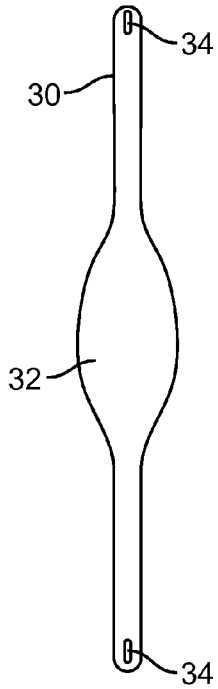
FIG. 5*a* is a front view of a first carrying handle of the modular beverage transport system.
Figure 5B:
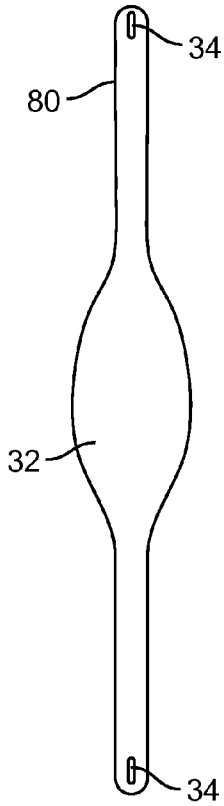
FIG. 5*b* is a front view of a second carrying handle of the modular beverage transport system.
Figure 5C:
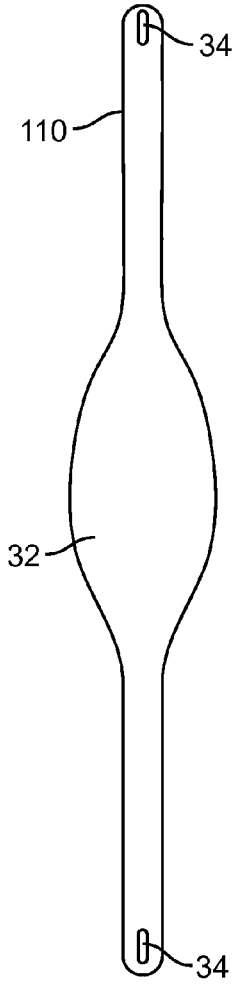
FIG. 5*c* is a front view of a third carrying handle of the modular beverage transport system; and, FIG. 6 is a perspective view of a locking fastener of the modular beverage transport system.

FIGS. 5*a*, 5*b*, 5*c* show front views of the carrying handles 30, 80, 110 of the modular beverage transport system 10. The carrying handles 30, 80, 110 enable connecting and carrying the embodiments 15, 50, 70, 90 using respective progressively longer appendages which correspond to the width of the embodiments 15, 50, 70, 90. This provides a stable one-handed grasping mechanism for transporting the containers 120 and/or tray assembly 91. Each carrying handle 30, 80, 110 beneficially has an ovular-shaped gripping section 32 and handle slots 34 at ends for attaching to the previously described container collars 20, 52, 72 using the quarter-turn fasteners 40 (see FIG. 6).

FIG. 6 presents a perspective view of a locking fastener 40 of the modular beverage transport system 10. Portions of the modular beverage transport system 10 are removably attached using plastic locking fasteners 40, each comprising a unitary molded part having a disc 42 and a perpendicularly protruding locking "T"-feature 44. In use, the "T"-feature 44 is inserted through corresponding fastener slots 22 and/or handle slots 34, and subsequently rotated ninety degrees (90°) to secure combinations of container collars 20, 52, 72, side reinforcing members 54, and carrying handles 30, 80, 110 together (see FIGS. 1 through 5).

It is envisioned that other styles and configurations of the present invention can be easily incorporated into the teachings of the present invention, and only one particular configuration shall be shown and described for purposes of clarity and disclosure and not by way of limitation of scope.

The preferred embodiments 15, 50, 70, 110 of the modular beverage transport system 10 can be utilized by the common user in a simple and effortless manner with little or no training. After initial purchase or acquisition of the modular beverage transport system 10, it would be assembled as indicated in FIGS. 1 through 4.

The method of assembling and utilizing the single-container embodiment 15 is performed by procuring quantities of first container collars 22, first carrying handles 30, and quarter-turn fasteners 40 as required to assemble a desired number of single-container embodiments 15; assembling each single-container embodiment 15 by inserting two (2) quarter-turn fasteners 40 through respective fastener slots 22 of the first container collar 22 and subsequently through aligned handle slots 34 of the first carrying handle 30; rotating the quarter-turn fasteners 40 ninety degrees (90°) to secure the first container collar 22 to the first carrying handle 30; inserting the first container collar 22 upwardly around the container 120 or inserting a beverage container 120 downwardly into the first container collar 20 while holding the first elastic band 24 at a side location; positioning the first elastic band 24 diametrically across a top surface of the container 120 to secure the container 120 or a lid of the container 120; grasping and lifting the gripping section 32 of the first carrying handle 30 to lift the single-container embodiment 15; and, transporting the single-container embodiment 15 in a "one-handed" manner to a destination for normal consumption.

The method of assembling and utilizing the two-container embodiment 50 may be achieved by performing the following steps: procuring quantities of two-container collar assemblies 51, first carrying handles 30, and quarter-turn fasteners 40 as required to assemble a desired number of two-container embodiments 50; assembling each two-container embodiment 50 by inserting two (2) quarter-turn fasteners 40 through respective fastener slots 22 of the two-container collar assembly 51 and subsequently through aligned handle slots 34 of the first carrying handle 30; rotating the quarter-turn fasteners 40 ninety degrees (90°) to secure the two-container collar assembly 51 to the first carrying handle 30; and, utilizing the two-container embodiment 50 in a similar manner as the previously described single-container embodiment 15 to transport a pair of beverage containers 120.

The method of assembling and utilizing the four-container embodiment 70 may be achieved by performing the following steps: procuring quantities of four-container collar assemblies 71, second carrying handles 80, and quarter-turn fasteners 40 as required to assemble a desired number of four-container embodiments 70; assembling each four-container embodiment 70 by inserting two (2) quarter-turn fasteners 40 through respective fastener slots 22 of the four-container collar assembly 71 and subsequently through aligned handle slots 34 of the second carrying handle 80; rotating the quarter-turn fasteners 40 ninety degrees (90°) to secure the four-container collar assembly 71 to the second carrying handle 80; and, utilizing the four-container embodiment 70 in a similar manner as the previously described single-container embodiment 15 to transport four (4) beverage containers 120.

The method of assembling and utilizing the four-container with tray embodiment 90 may be achieved by performing the following steps: procuring quantities of two-container collar assemblies 51, third carrying handles 110, and quarter-turn fasteners 40 as required to assemble a desired number of four-container with tray embodiments 90; assembling each four-container with tray embodiment 90 by inserting two (2) quarter-turn fasteners 40 through the inner fastener slots 22 of the two-container collar assemblies 51, being positioned on each side of the tray assembly 91, and subsequently through aligned fastener slots 22 of the tray assembly 91; rotating the quarter-turn fasteners 40 ninety degrees) (90° to secure the two-container collar assemblies 51 to the tray assembly 91; inserting two (2) quarter-turn fasteners 40 through outer fastener slots 22 of the two-container collar assemblies 51, and subsequently through aligned handle slots 34 of the third carrying handle 110; rotating the quarter-turn fasteners 40 ninety degrees (90°) to secure the two-container collar assemblies 51 to the third carrying handle 110; and, utilizing the four-container with tray embodiment 90 in a similar manner as the previously described single-container embodiment 15 to transport four (4) beverage containers 120 and other items such as food stuffs, condiments, and the like, using the tray assembly 91.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A modular beverage transport comprising:

a first container collar assembly having a first pair of cylindrical container collars that are connected together by a first pair of side reinforcing members, wherein at least one of said side reinforcing members has a fastener slot;

a second container collar assembly having a second pair of cylindrical container collars that are connected together by a second pair of side reinforcing members, wherein at least one of said side reinforcing members has a fastener slot;

a carrying handle having a pair of handle slots;

a pair of rigid quarter-turn fasteners, wherein each of said pair of rigid quarter-turn fasteners having a disc and a "T"-shaped locking feature that extends from said representative disc; and, a box disposed between said first container collar assembly and said second container collar assembly;

wherein each of said "T"-shaped locking features passes through one of said fastener slots and one of said handle slots such that when said "T"-shaped locking features are turned said carrying handle is connected to said first container collar assembly and to said second container collar assembly.

2. The modular beverage transport according to claim 1, wherein said first container collar assembly is attached to said second container collar assembly.

3. The modular beverage transport according to claim 1, wherein said box is attached to said first container collar assembly by a third rigid quarter-turn fastener.

4. The modular beverage transport according to claim 1, further including an elastic band connected across a diameter of said first pair of cylindrical container collars.

* * * * *